United States Patent [19]

Moir

[11] 4,411,134

[45] Oct. 25, 1983

[54] APPARATUS FOR THE REPAIR AND REPLACEMENT OF TRANSITION DUCTS ON JET ENGINES AND BRACKET THEREFOR

[76] Inventor: David L. Moir, Lake Ronkonkoma, N.Y.

[21] Appl. No.: 314,573

[22] Filed: Oct. 26, 1981

[51] Int. Cl.[3] ..... F02C 7/20

[52] U.S. Cl. ..... 60/39.31; 60/39.32; 60/39.37; 60/722; 138/159; 403/344

[58] Field of Search ..... 60/39.31, 39.32, 39.36, 60/39.37, 722, 39.75; 403/344; 138/159, 160

[56] References Cited

U.S. PATENT DOCUMENTS

| | | | |
|---|---|---|---|
| 2,544,538 | 3/1951 | Mahnken et al. | 60/39.32 X |
| 3,086,363 | 4/1963 | Fiori | 60/39.31 X |
| 3,519,726 | 7/1970 | Ewing | 138/159 X |

FOREIGN PATENT DOCUMENTS

| | | | |
|---|---|---|---|
| 2044320 | 10/1980 | United Kingdom | 403/344 |

*Primary Examiner*—Louis J. Casaregola
*Assistant Examiner*—Donald E. Stout
*Attorney, Agent, or Firm*—Bauer & Amer

[57] ABSTRACT

A replacement transition duct assembly for a jet engine comprised of a plurality of complementary louvered sections having joining ends that are assembled together about the engine by means of a novel bracket. The bracket is formed with a spaced array of louvered segments adapted to interfit with and receive the joining ends of the replacement duct sections, and includes an offset element to which the joining ends are secured. When the joining ends are secured to the bracket, the bracket provides an effective seal between the replacement duct sections, presents a minimum impediment to the flow of exhaust gases, and completes the integral formation of the replacement transition duct assembly.

11 Claims, 8 Drawing Figures

APPARATUS FOR THE REPAIR AND REPLACEMENT OF TRANSITION DUCTS ON JET ENGINES AND BRACKET THEREFOR

This invention relates to a method and apparatus for repairing transition ducts on jet engines.

In certain applications, gas turbine engines are employed by utility companies for generating electricity. These turbines are essentially standard jet engines. A transition duct, bolted aft of the combustion chamber, directs the gaseous thrust onto the turbine assemblies of the engine. The shaft of the free turbine then drives an electrical generator or D.C. generator. The overall structure of the jet engine and free turbine is substantially unitary, and many critical parts are so secured or welded together as to form a monolithic construction. For example, the transition duct is supplied as a one-piece assembly that is bolted onto a spacer rim collar located immediately after the burner plate support assembly.

The heat of the exhaust gases emanating from the combustion chamber and impinging on the transition duct assembly is tremendous and, therefore, the duct is made of a material that is intended to resist the high heat of the exhaust gas. However, after a period of time, and after being subjected to the tremendous temperatures and pressures of the exhaust gases, parts of the transition duct tend to crack. In so doing, these parts may break away from the duct and, under the high thrust forces of the exhaust gases, fly into the turbine assemblies positioned aft of the engine. The flying pieces of duct obviously do great damage to the turbine assemblies, require great expense to repair the turbine, and result in expensive downtime and lost use of the overall system.

In the past, when the transition duct assembly became defective or showed excessive fatigue, it was necessary to take the entire engine out of service and disassemble substantially half of the jet engine to afford access to, and to enable removal and replacement of, the damaged duct assembly. Moreover, replacement of any part of the transition duct assembly required replacement of the entire transition duct assembly.

The present invention is designed to overcome the serious limitations relating to repair of the transition duct assembly as outlined above. In general, and according to the present invention, an outer engine cover or cowling that conventionally covers the transition duct and engine is removed to provide access to the damaged transition duct. The damaged outer transition duct or duct assembly is then sectioned according to the teaching of the invention, preferably along the longitudinal axis of the engine, allowing the same to be unbolted and easily removed in such smaller sections from within the engine housing or compartment. A new transition duct is then supplied and it is comprised of a plurality of sections each having complementary sized and shaped joining ends. The new transition duct sections are then brought up into position on the engine of the old removed sections and bolted together in place by means of a novel bracket.

The novel bracket of the instant invention is substantially T-shaped and comprises an elongate plate-like body member that, preferably, has one face, the inboard face, of substantially smooth configuration. The other, or outboard face, of this plate-like member is provided with a spaced array of louvered segments sized and shaped complementary to and thus adapted to receive and interfit with the joining ends of the new transition duct sections.

A radially directed mounting wall element or offset leg is welded substantially perpendicular to or formed unitary with the plate-like member along the aforementioned outboard face thereof and thus is made integral therewith. The offset leg or wall element is positioned lengthwise of the body member so as to be substantially cross-axis to the transverse disposition of the spaced array of louvered segments, and substantially splits or divides the same along their lengths. Thus, when the respective joining ends of the new duct sections are received in the bracket, they are moved toward and into abutting relation with respective faces of the offset wall element or, put another way, the offset wall provides surfaces against which respective section receiving ends abut and to which they are joined.

The respective ends of the new duct sections that are received in the bracket are joined thereto by means of substantially symmetrically placed angle brackets and held adjacent to or in abutting engagement against the offset wall by any convenient means of securement, as bolts and nuts. Since the louvered segments of the brackets closely engage respective louvers of the joining ends of respective transition duct sections, a good seal is effected between facing lateral edges of the new transition duct sections.

The planar inboard face of the bracket is so disposed along the inside peripheral surface of the new replacement transition duct assembly as to present a minimum or obstruction to the glow of engine gases thereover. By positioning the offset wall of the bracket outboard of the new assembled sections of the transition duct, the same is out of the path of the engine gases and is readily accessible for subsequent removal, repair and/or replacement.

If desired, the new outer transition duct assembly can be supplied in any convenient number of sections to accord with expected wear and fatigue patterns. This will permit having to remove only localized sections of the inventive transition duct assembly for routine maintenance. Because the inventive method contemplates placing the bracket member between respective adjacent jet engine burner can apertures, i.e., the dead space between burner can exhausts, the inventive structure will be essentially out of the direct flow path of the exhaust gases, thus adding to its overall lifetime.

It is, therefore, an object of the present invention to provide a method for the repair and replacement of transition ducts on jet engines.

It is a further object of the present invention to provide for a method of repair and replacement of a transition duct on a jet engine wherein replacement of the duct does not require total dismantling of the engine.

It is another object of the present invention to provide a method of assembling sections of a replacement transition duct assembly that are used on a jet engine wherein the resulting replacement assembly presents essentially the same geometry as the original one-piece transition duct assembly.

It is a further object of the present invention to provide a bracket for use in joining sections of a transition duct assembly such that the bracket firmly clamps facing ends of adjacent joined sections giving rise to a structure that exhibits dimensional stability under high temperature and pressure.

It is another object of the present invention to provide a bracket to be used in assembling sections of a transition duct assembly wherein one part of the bracket has sections that conform in shape and size to receive joining ends of the new duct sections and wherein another part of the bracket presents a smooth face to the flow of exhaust gas.

It is yet a further object of the present invention to provide a method for the repair and replacement of a transition duct on a jet engine that is relatively easy to perform, requires no special tools, and that is relatively lower in cost and more easily and rapidly performed than prior known procedures.

Other objects and features of the present invention will become apparent from the following detailed description considered in connection with the drawings. It is to be understood, however, that the drawings are designed for purposes of illustration only and not as a definition of the limits of the invention for which reference should be made to the appending claims.

In the drawings, wherein the same reference numeral denotes the same element throughout the several views.

Figure 2:
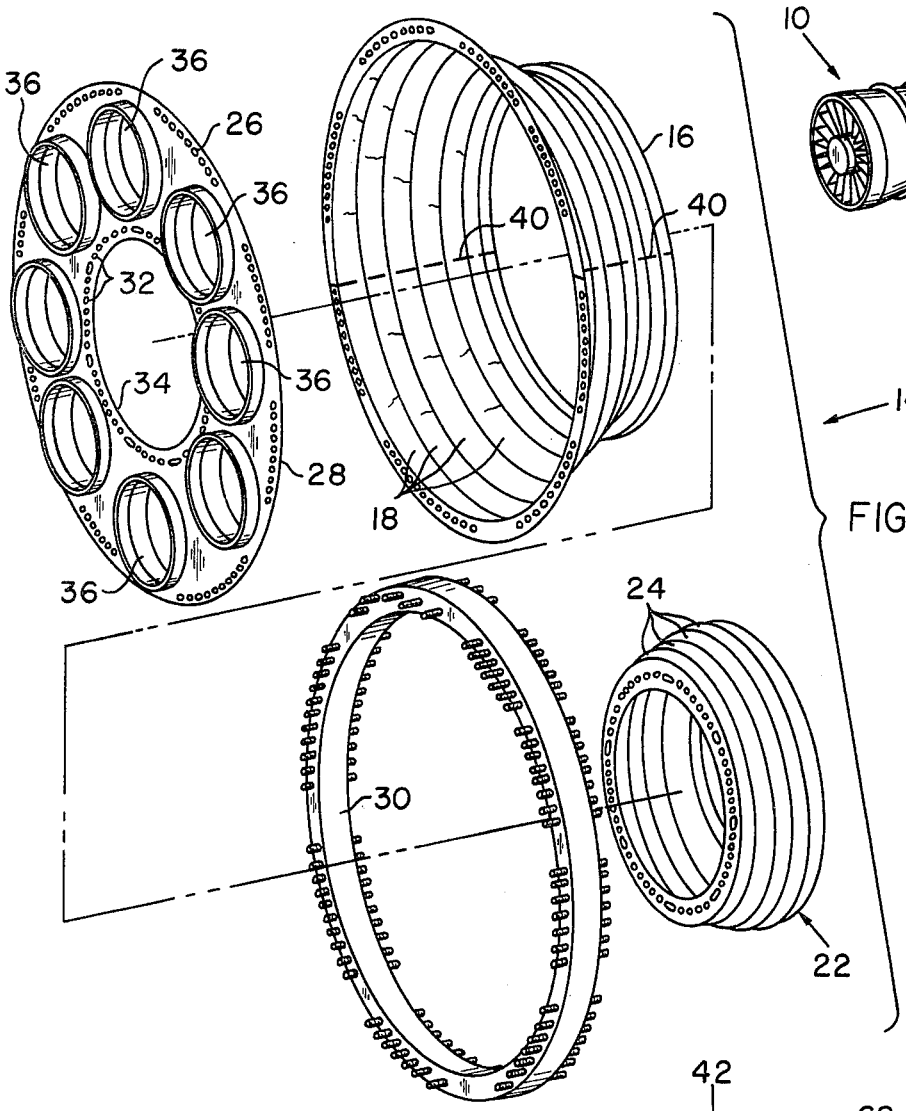
FIG. 2 is an exploded perspective view of the transition duct assembly to reveal an outer transition duct and inner transition duct.
Figure 1:
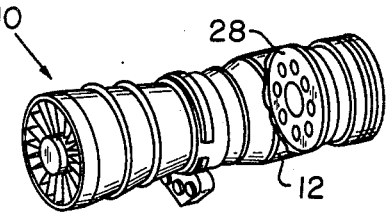
FIG. 1 is a diagrammatic perspective view showing the location of a transition duct assembly on a jet engine, the assembly is seen aft of the burner cans and fore of the free turbine structure.

Referring to the drawings, a conventional jet engine generally identified 10, is seen in FIG. 1. As is conventional, the engine 10 is covered by multisectioned housing and combustion cover 12, that, being on the outside of the engine, is easily removed to expose and provide access to the engine interior and to the old transition duct assembly, indicated generally by numeral 14 in FIG. 2. The assembly 14 includes a louvered outer duct assembly 16 that is comprised of a plurality of annularly-spaced louvers 18 each joined together at their overlying marginal surfaces 20 as is seen more clearly in FIG. 7. A louvered inner duct assembly generally identified by numeral 22 in FIG. 2 is similarly comprised of a plurality of similarly joined annular louvers 24.

In the conventional assembly of the engine 10, outer duct assembly 16 is bolted at holes 26 to the outside annular rim of a burner can exhaust cover plate 28 by means of an intermediate connecting ring collar 30. The inner duct assembly 22 is likewise bolted directly onto the burner exhaust cover plate 28 that cooperates with holes 32 about the inside annular opening 34. Burner exhaust plate 28 includes a plurality of burner can exhaust ports or apertures 36 each aligned with a given one of a plurality of jet engine burner cans (not shown) and through which flow the hot exhaust gases of the engine. The engine burner cans are spaced circumferentially about the axis of the engine 10 beneath the cover 12 in FIG. 1. It will be apparent that the exhaust gases are confined to flow along the annular path defined between the outside annular periphery of inner duct assembly 22 and the inside annular periphery of the outer duct assembly 16.

By reason of the geometry of duct assemblies 16 and 22, and owing to the fact that they guide and have a nozzle effect on the flow of the tremendously hot gases emanating from the respective burner can exhaust apertures 36, these ducts are subjected to high thermal stresses in addition to having to withstand the tremendous pressures associated with the exhaust gas. Thus, the duct assemblies 16 and 22 are subjected to fatigue and this is particularly the case with respect to outer duct assembly 16.

Prior to the present invention, repair of the transition duct assemblies required the shutdown of the entire engine 10, putting it out of commission and use for substantial periods of time. Access to the annular assembly 16 required wholesale dismantling of the engine to permit its rmoval as a unit from between the turbine section and the burner cans. After the unitary removal of the duct assembly 16, a new replacement of a unitary duct assembly was substituted, as a whole, before the dismantled engine could be reassembled. This required many man-hours of labor, large expense and valuable lost time in the use of the engine.

In accordance with the present invention, the repair and replacement of the outer duct assembly 16 of the overall transition duct assembly 14 is accomplished relatively easier and more rapidly with a minimum of downtime of the engine. That portion of the combustion cover 12 of engine 10, facing and annularly covering the transition duct assembly 14, is unbolted and removed rearward before the engine burner cans are removed in the conventional manner. This exposes the old outer transition duct assembly 16. The duct assembly 16 is rendered easily removable by separating it into a plurality of sections along its longitudinal length by making a corresponding plurality of saw cuts as shown by broken lines 40 as seen diagrammatically in FIG. 2. After the duct 16 is cut into sections as shown, the old sections of the duct 16 can be removed from within the engine without disturbing the turbine on the opposite longitudinal sides of the transition duct assembly 16 thereby avoiding dismantling the entire engine as was required before this invention.

A new replacement transition duct assembly may now be positioned in place of and substituted for that of the old assembly 16. The new duct assembly is shown more fully in FIGS. 6, 7 and 8 and is generally identified by the numeral 42. The new assembly 42 is made in a plurality of two or more sections 44 and 46 that are composed of louvers 47 joined together at 20 as seen in FIG. 7 in the same manner as were the louvers of the old duct assemblies 16 and 22. Although the replacement duct 42 may be formed in any desired number of sections, in practice it has been found that when they are made in the two halves 44 and 46 as shown in FIGS. 7 and 8, the same are convenient to handle and reassemble readily at the location of the old duct assembly 16. Thus, other than for the fact that the new replacement duct 42 is formed in sections 44 and 46, the same is essentially of the same construction as the old duct 16.

The new duct sections 44 and 46 are assembled into a unitary structure within the engine 10 by a novel T-shaped bracket 48 shown in FIGS. 3 to 8. Bracket 48 is sized and shaped complementary to the joining ends of the duct sections 44 and 46 to receive the same in interfitting engagement therewith. More particularly, the T-shaped bracket 48 comprises a plate-like elongate rectangular head member 49 having two substantially smooth opposite inner and outer planar faces 50 and 52. A spaced array of louver-shaped segments or plates 54 are disposed on the face 50. Each louvered segment 54 of the spaced array is positioned on the head member 49 so that the same is adapted to matingly receive and interfit with an associated joining or mating end of a new adjacent duct section 44 and 46, as the case may be.

The relative arrangement of louvered segments 54 on the bracket face 50 allows the same to receive and interfit with a like relative arrangement of louvered sections 47 of a respective transverse facing or mating end of a duct section 44 and 46. It is to be understood that the closeness or snugness of fit between respective receiving louvers 54 on bracket 48 and interfitting louver sections 47 on a corresponding joining end of a new duct section 44 or 46 will take into consideration the thermal expansion to which each of these elements is subjected during engine operation so that when these elements are at operating temperature, the respective louvered segments 54 on the bracket 48 closely grasp and interfit with the received portions of the louver sections 47.

A radially oriented planar offset leg or wall element 56 is affixed or unitarily welded to and along the face 50 of the bracket 48. The offset wall 56 is oriented at cross-axis to the axial disposition or the lengthwise array of louvered segments 54. As is illustrated in FIGS. 3, 5, 6 and 7, it essentially divides or splits the array of louvered segments 54 in half, on either side of the face 50. Being formed as an integral part of the bracket 48, the wall 56 extends in a direction generally perpendicular to the plane presented by planar face 50 of the head member.

Each of the new duct sections 44 and 46 of the new duct assembly 52 are provided with a curved wall 58 that projects from and as a part of the final louver 47 as seen in FIG. 7. A locating element 60 is conventionally mounted to the final louver 47 and is spaced from the wall 58 to enable the proper positioning of the duct assembly 16 with respect to the remaining structure of the engine 10. Although the specific details of the element 60 form no part of the present invention, they are shown to enable a clearer understanding of the present inventive teaching. Because the walls 58 and 60 form a part of the old transition duct assembly 16, they are here shown and discussed to make it clear that whatever structure was included in the old removed duct assembly 16 will be included as part of the replacement duct assembly 42. Hence, the illustration of the walls 58 and 60.

The offset wall 56 is configured so as generally to conform to the outer configuration of the duct wall 60 to permit securement therewith and to avoid interference with adjacent engine structures. The wall 56 includes an integral extending tab 62 that conforms at 63 to the exposed outer surface of the wall 60 as in FIG. 7. The longitudinal end 64 of the plate-like head member 49 is curved in a direction generally towards the tab 62 with the immediate distal end bent back upon itself along a small radius to form a hook-like guide rail or slide opening 66. Because tab 62 has its surface 63 formed complementary to the outside peripheral contour of the edge of the walls 60 of each of the new duct sections 44 and 46, it will be engaged therewith in abutting relation when the new duct sections are secured to the bracket 48.

Figure 6:
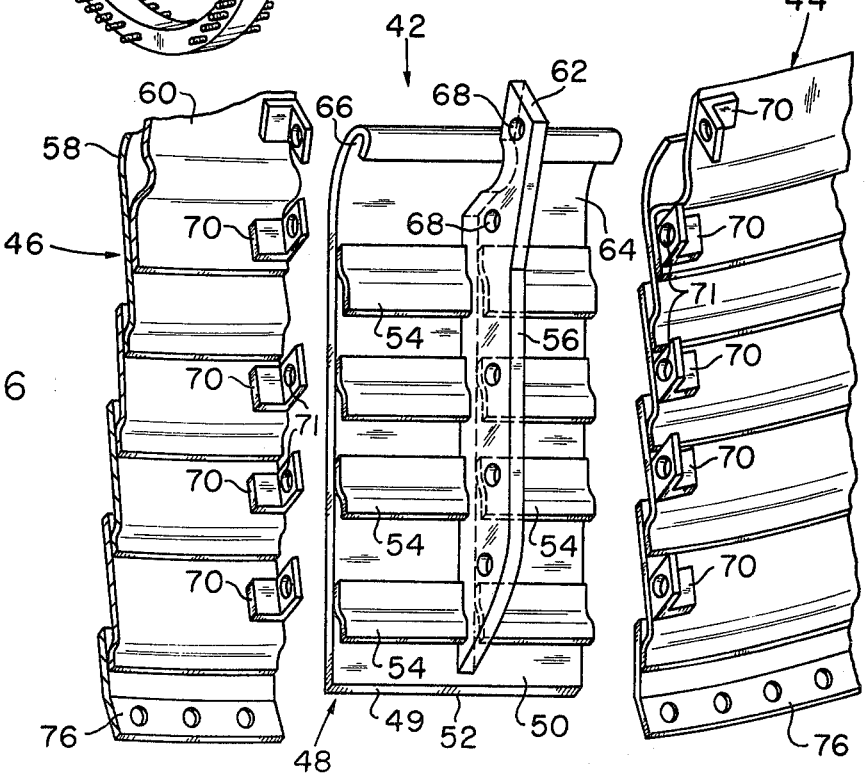
FIG. 6 is a perspective view showing the inventive bracket about to join facing ends of adjacent sections of a replacement outer transition duct according to the invention.
Figure 3:
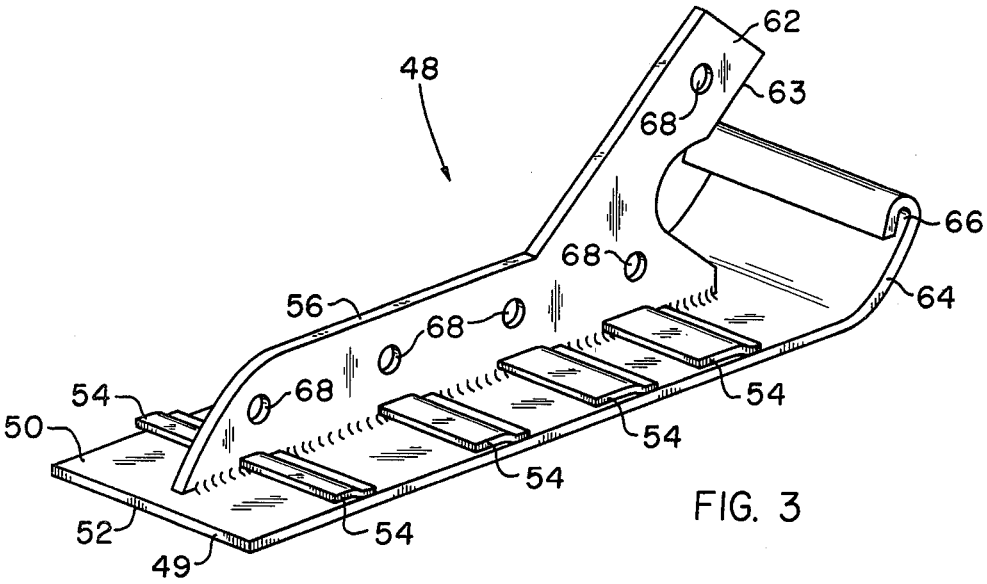
FIG. 3 is a perspective view of the bracket of the instant invention.
Figure 5:
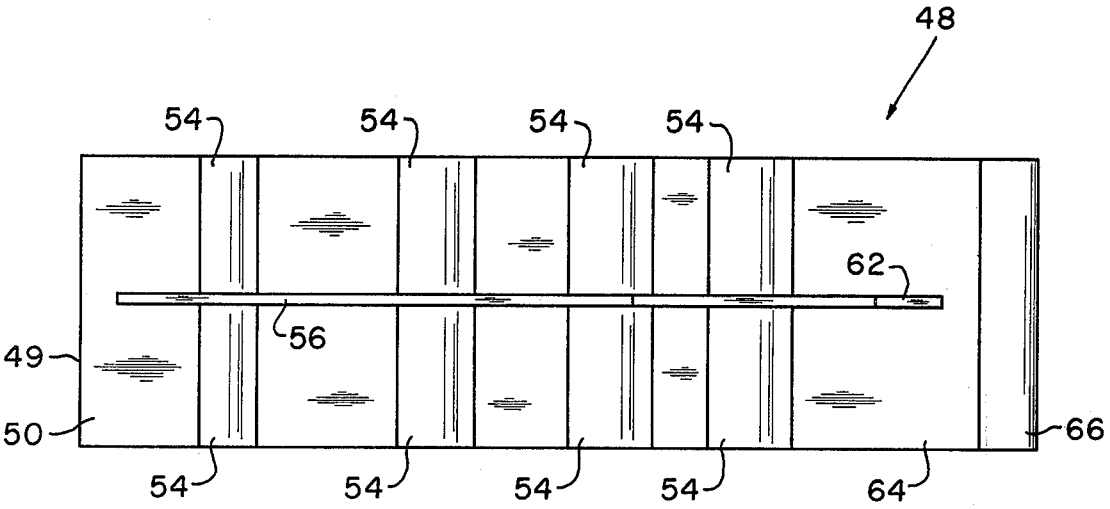
FIG. 5 is a top view of the bracket shown in FIG. 4.
Figure 4:
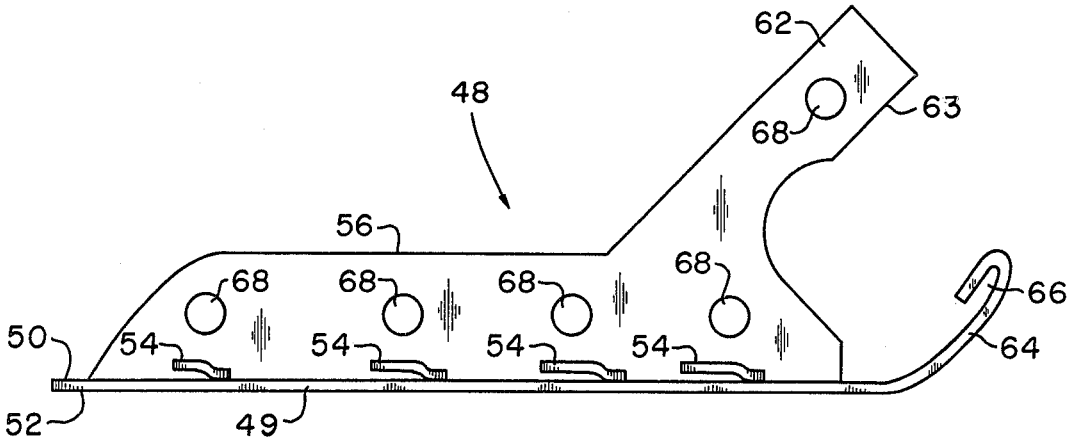
FIG. 4 is a front elevational view of the inventive bracket shown in FIG. 3.
Figure 7:
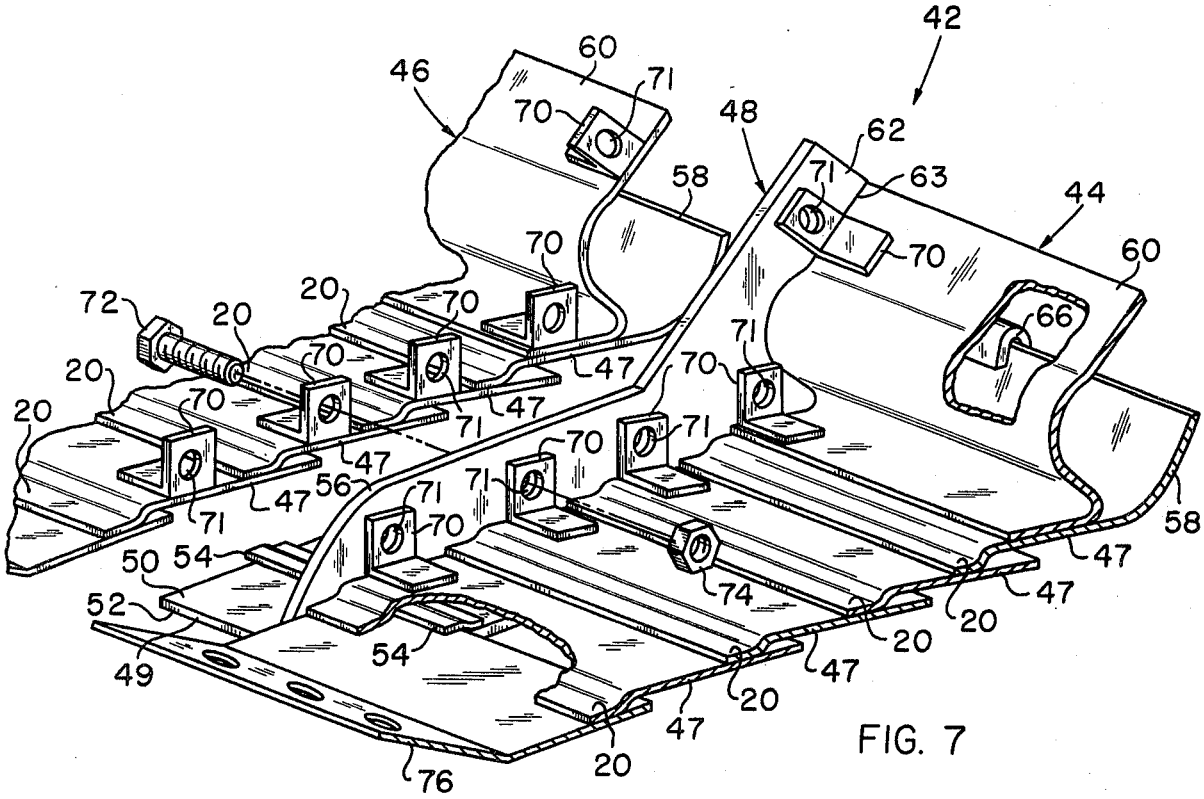
FIG. 7 is an enlarged perspective view illustrating the assembly of one of the replacement sections of the replacement outer transition duct with the bracket.
Figure 8:
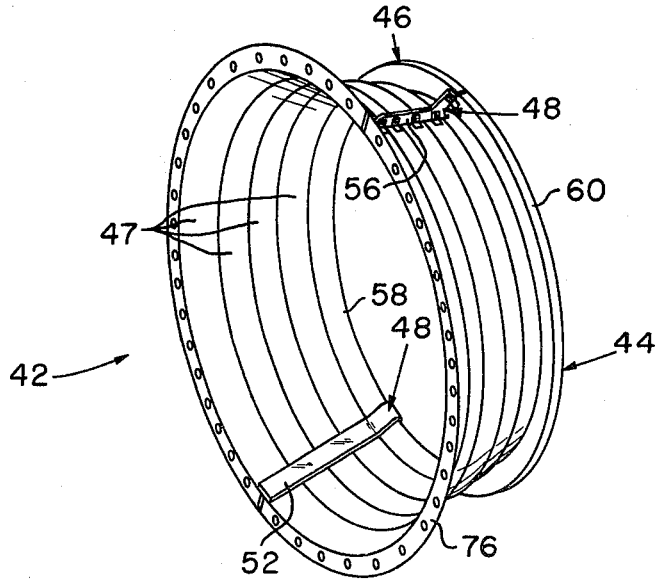
FIG. 8 is a perspective view showing the sections of the replacement outer transition duct assembled according to the invention removed from the engine for clarity.

In use, the bracket 48 receives the adjacent ends of at least two new transition duct sections 44 and 46 of the new transition duct assembly 42 in the manner as is illustrated more clearly in FIGS. 6, 7 and 8. Each of the new transition duct sections 44 and 46 are positioned within the space of the engine 10 from which the old transition duct assembly 16 had been removed. Hence, the new duct assembly 42 will assume the original position and perform the same function as the original replaced duct 14 or any part thereof. The two new duct sections 44 and 46 are now ready to be secured together into a unitary new transition duct assembly 42 with the interposition of the brackets 48.

To accomplish this, the transverse or adjacent ends of the two new duct sections 44 and 46 are slid into interfitting, received engagement and mounting relationship with the mounting bracket 48. Since there are two duct sections illustrated in FIG. 8 as constituting the new transition duct assembly 42, it will be necessary merely to secure together such new duct sections 44 and 46 with two brackets 48. Each of the brackets 48 is positioned between the mating ends of the duct sections 44 and 46 so that the louvered segments 54 on opposite sides of the dividing wall 56 of the brackets 48 receive and mate in interfitting engagement with corresponding or respective louvers 47 of the two sections 44 and 46.

In actual practice, one of the sections 44 or 46 is first interfitted with the array of louvered segments 54 on one side of the wall 56 of bracket 48, and then the other section is interfitted with the respective array of louvered segments on the other side of the wall 56 of the bracket 48. The interfitting receipt and adjustment of the sections 44 and 46 with their respective brackets 48 is accomplished readily because the louvered segments 54 on the bracket mate substantially into close conforming relationship with the louvers on the sections 44 and 46. Thus, the relative positioning of the sections 44 and 46 and the brackets 48 is accomplished quickly and easily without the requirement for great skill.

The interfitting receipt and engagement of the sections and brackets is enhanced by the guide rail opening 66 that is provided at the end 64 on the plate 49 of the bracket 48. The free end of the curved wall 58 of each louvered section 44 and 46 is positioned so as to align with and to be received in guided sliding engagement with the opening 66 of the guide rail provided on the bracket 48. Thus, the cooperation of the guide rail 66 with the end 58 of each of the sections 44 and 46 and the further interfitting receiving cooperation between the spaced array of louvered segments 54 with the louvers 47 of each of the sections 44 and 46 properly positions both the brackets and the sections in interengaged locking relationship.

After the brackets and adjacent section ends are joined together in the manner as described, it is merely necessary to secure and retain them in locked relationship in their position of replacement within the engine of that of the old transition duct assembly 16. This is accomplished simply by initially providing the leg or wall 56 of the bracket with a plurality of preformed openings 68 each of which is previously selectively located as to be aligned with a respective right angled bracket 70. Each bracket 70 may be previously mounted on the adjacent joining ends of each of the sections 44 and 46.

As illustrated in FIG. 7, the brackets 70 are shown positioned in alignment with the transverse edges of each of their respective sections 44 and 46. In this manner, when each of the sections is interfitted and received at their louver sections 47 with the array of louvered segments 54 of the bracket 48, the transverse edges of each such section will abut against the facing wall 56 of the bracket. This automatically locates the flat facing wall of each of the right angle brackets 70 in full face abutment with the same adjacent wall 56 of the bracket 48 and with their holes 71 in alignment with a respective securement hole 68 on the bracket wall 56.

Thereafter, all that is necessary is to securely affix each of the angle brackets 70 to the adjacent abutting wall 56 of the bracket 48. This can be accomplished in any number of ways. As most conveniently illustrated in FIG. 7, this is shown to be accomplished by the use of a bolt 72 that need merely be inserted through the previously aligned holes 68 and 71 and then locked securely together by a nut 74. The securing nuts and bolts may be wired together as is conventional (not shown) to prevent their accidental displacement or disassembly. This interfitted arrangement of brackets and duct sections adds to the stability and rigidity of the overall new transition duct assembly 42.

Because the louvered segments 54 and the wall 56 are disposed on the outboard face 50 of the plate member 49, when the bracket 48 and duct sections 44 and 46 are secured together, the smooth inboard planar face 52 becomes disposed along the inside periphery of newly assembled transition duct assembly 42 as seen in FIG. 8. The smoothness of the face 52 permits the engine exhaust gases to flow smoothly thereover from the burner can apertures 36 without interruption or obstruction thereby. Moreover, it will be apparent that the elongated member 49, along its face 52 to its guide rail 66, completely covers and bridges the full length of the joint existing between mating ends of the newly secured transition duct sections 44 and 46 while the wall 56 fully fills the space or void that might otherwise exist between their adjacent ends. This arrangement thereby prevents the passage or leakage of engine exhaust gas therebetween.

It will be apparent that when the new transition outer duct sections 44 and 46 are supplied, their circumferential dimensions will be reduced to take into account the thickness of the offset wall element 56 of the bracket 48 so that when the new duct sections are fully assembled, as seen in FIG. 8, the overall diameter of the assembled replacement transition duct 42 will equal to and will be an exact replacement for the old duct 16. When the new transition duct 42 is assembled and mounted to the annular rim 26 by bolting at the annular face 76, it is preferred that the brackets 48 be adjusted circumferentially to be located in the dead space, as it were, that exists between adjacent engine burner can apertures 36. When so located, each bracket 48 is out of the direct line of discharge and flow of the tremendously hot exhaust gases emanating from each burner can opening 36 so that the full heat of the gases does not impinge directly upon the brackets.

While the present invention has been shown used in conjunction with the repair and replacement of an outer transition duct assembly 42, the inventive method and apparatus is not to be so limited. Clearly, it can be applied to the inner duct assembly 22, and more generally, to any louvered duct assembly. It should be apparent that in accordance with the present invention, the new replacement transition duct 42 that is to be assembled about the engine can be sectioned into any other feasible number of mating sections all to be interfitted with a corresponding number of securing brackets 48. By supplying the duct in many sections, localized sections of the duct 42 that are especially prone to cracking can be replaced without having to dismantle other parts of the duct or other parts of the engine 10.

While only a few embodiments of the present invention have been shown and described, it is to be understood that many changes and modifications can be made hereto without departing from the spirit and scope hereof.

What is claimed is:

1. Apparatus for replacing a fatigued transition duct assembly on a jet engine comprising a replacement louvered transition duct formed as a plurality of sections each of which has complementary joining ends, a bracket, said bracket being defined by a planar member having two faces, a spaced array of louvered segments affixed to one face of said planar member such that respective ones of said louvered segments are adapted to receive and interfit with respective ones of the louvers of adjacent joining ends of two of said duct sections, a rigid offset element affixed to and extending from said one face of said planar member with the plane of said offset element disposed essentially at right angles to the disposition of said louvered segments and oriented so as to substantially divide the same, and means on said joining ends of said duct sections for assembling the same to said offset element whereby when said joining ends of said duct sections are received in said bracket and assembled on opposite sides of said offset element, each of said louvered segments substantially fills the space of the respective louver of the joining ends and causes the other face of said planar member to be disposed along the interior periphery of the assembled duct sections effectively bridging and sealing the joint that exists therebetween.

2. A louvered annular transition duct assembly for a jet engine comprising a plurality of initially separate substantially identical louvered arcuate sections which when joined together at their ends form the louvered annular transition duct assembly, a plurality of brackets each having louvers corresponding in shape and number to the louvers of said separate arcuate sections to receive the joining ends of two adjacent ones of said separate sections and the louvers thereof, said brackets each including a wall disposed between the received joining ends of the two separate sections, and means securing together said included wall and said two separate sections received by each of said brackets to form said transition duct assembly into a rigid integral annulus with the louvers of each of the arcuate sections in annular alignment.

3. The improvement of claim 2, said bracket including a member having two faces, said wall extending from one of said faces at substantially right angles thereto to enable said arcuate sections to be secured integrally therewith.

4. The improvement of claim 3, said member being elongated and substantially rectangular, one of the longitudinal ends of said rectangular member spaced from and bent back upon itself to form an arcuate guide opening to receive and engage with a rim of a respective one of said arcuate sections received by said bracket.

5. The improvement of claim 2, said securing means including a plurality of spaced, apertured, right-angle brackets to be affixed to and between and flush with each of said joining ends of said arcuate sections and said bracket wall, a plurality of spaced apertures disposed through said wall with certain ones of said wall apertures being in alignment with respective apertures of certain ones of said right-angle brackets, and securing means received through said aligned apertures of said right-angle brackets and said wall to secure said arcuate sections, right-angle brackets together with said bracket wall.

6. A bracket for assembling the joining ends of a plurality of louvered transition duct sections comprising a planar member having two substantially planar faces, a spaced array of louvers on one planar face of said planar member corresponding in size and number to the louvers of the duct sections to interfit with and receive the louvers and joining ends of adjacent duct sections, an offset element unitary with and extending substantially perpendicular to said one planar face of said planar member with the plane of said offset element being substantially perpendicular to said spaced array of louvers whereby when adjacent joining ends of two of the duct sections are received in said bracket and interfit with respective ones of said spaced array of louvers of the joining ends of the duct sections, they substantially abut against said planar offset element on opposite sides thereof in facing disposition, and means on said bracket securing the joining ends of the duct sections to said offset element thus to securely assemble the plurality of transition duct sections together into a rigid, integral whole.

7. The bracket of claim 6, said means on said bracket including a plurality of spaced apertures disposed through said offset element for enabling the joining ends of the sectioned louvered duct to be bolted to said element thereat.

8. The bracket of claim 7, said planar member being of elongate substantially rectangular configuration and having two longitudinal ends, said offset element including an extending tab having a contoured edge disposed so as generally to face one of said longitudinal ends of said planar member, said one longitudinal end of said planar member having guide means that conforms to and mates with portions of the transition duct sections.

9. A bracket for assembling thereto the end of a section of a louvered duct comprising an elongated member having two substantially planar faces, a plurality of spaced, louvered segments affixed to one of the planar faces transverse to the length of said member and disposed in substantial parallel array thereon, a planar wall extending along and for an effective length of and from said one planar face and outward therefrom, substantially perpendicular thereto, and positioned thereon so that the plane of said wall divides the transverse extent of said array of louvered segments, and means on said wall for securement with louvers of a louvered duct segment that may be interfitted with and be received in and between said louvered segments and said one planar face of said bracket.

10. The bracket of claim 9, said elongated member being substantially rectangular, said wall being spaced from one of the longitudinal ends of said member, said one longitudinal end being formed with a guide opening defined therein for the receipt and guided movement therein of a section of a louvered duct.

11. The bracket of claim 10, said wall having a tab directed generally toward said guide opening and spaced therefrom.

* * * * *